US010202221B2

(12) United States Patent
Boukobza

(10) Patent No.: US 10,202,221 B2
(45) Date of Patent: Feb. 12, 2019

(54) COMBINED PETALOID BASE OF A CONTAINER

(75) Inventor: Michel Boukobza, Octeville sur Mer (FR)

(73) Assignee: SIDEL PARTICIPATIONS, Octeville sur Mer (FR)

( * ) Notice: Subject to any disclaimer, the term of this patent is extended or adjusted under 35 U.S.C. 154(b) by 0 days.

(21) Appl. No.: 13/988,198

(22) PCT Filed: Nov. 22, 2011

(86) PCT No.: PCT/FR2011/052729

§ 371 (c)(1),
(2), (4) Date: Jun. 12, 2013

(87) PCT Pub. No.: WO2012/069759

PCT Pub. Date: May 31, 2012

(65) Prior Publication Data

US 2013/0264305 A1 Oct. 10, 2013

(30) Foreign Application Priority Data

Nov. 25, 2010 (FR) ..... 10 04588

(51) Int. Cl.
*B65D 23/00* (2006.01)
*B65D 1/02* (2006.01)

(52) U.S. Cl.
CPC ..... *B65D 23/001* (2013.01); *B65D 1/0284* (2013.01)

(58) Field of Classification Search
CPC .. B65D 23/001; B65D 1/0284; B65D 1/0223; B65D 2501/0081; A47G 19/2205
USPC ..... 220/604, 605, 606; 215/371, 372, 373, 215/734, 375
See application file for complete search history.

(56) References Cited

U.S. PATENT DOCUMENTS 5,713,480 A * 2/1998 Petre ..... B65D 1/0284 215/373
7,520,400 B2 * 4/2009 Young et al. ..... 215/375
7,789,255 B2 * 9/2010 Zoppas ..... B65D 1/0284 215/375
8,439,214 B2 * 5/2013 Darr et al. ..... 215/382
(Continued)

FOREIGN PATENT DOCUMENTS

EP 0 350 782 A2 1/1990
EP 0 703 152 A1 3/1996
(Continued)

OTHER PUBLICATIONS

International Search Report of PCT/FR2011/052729 dated Feb. 17, 2012.

*Primary Examiner* — James N Smalley
*Assistant Examiner* — Madison L Poos
(74) *Attorney, Agent, or Firm* — Sughrue Mion, PLLC

(57) ABSTRACT

Container (1) made of plastic material comprising a body (2) and a petaloid bottom (3) extending the body (2), the bottom (3) comprising a bottom wall (4) that is generally convex towards the exterior, from which feet (5) protrude that are formed by excrescences, the feet being separated side by side by portions of the bottom wall forming hollow valleys (13) that extend radially from a central zone (6) of the bottom to a periphery (7) of the bottom, characterized in that each valley (13) widens out from the central zone (6) towards the periphery (7) and has a concave portion (15) located near the periphery (7).

16 Claims, 2 Drawing Sheets

(56) References Cited

U.S. PATENT DOCUMENTS

| | | | | |
|---|---|---|---|---|
| 9,428,296 | B2 | 8/2016 | Boukobza | |
| 2004/0173565 | A1* | 9/2004 | Semersky et al. | 215/382 |
| 2008/0223816 | A1* | 9/2008 | Darr | B65D 1/0223 215/382 |
| 2008/0302758 | A1* | 12/2008 | Mody et al. | 215/375 |
| 2009/0020682 | A1 | 1/2009 | Penet et al. | |
| 2009/0263534 | A1* | 10/2009 | Lesueur | B29C 49/48 425/522 |

FOREIGN PATENT DOCUMENTS

| | | | |
|---|---|---|---|
| FR | 2 717 443 | A1 | 9/1995 |
| FR | 2 772 720 | A1 | 6/1999 |
| FR | 2 897 292 | A1 | 8/2007 |
| WO | 86/05462 | A1 | 9/1986 |
| WO | 98/28193 | A1 | 7/1998 |
| WO | 2011/131893 | A1 | 10/2011 |
| WO | 2012/069759 | A1 | 5/2012 |

* cited by examiner

FIG.3
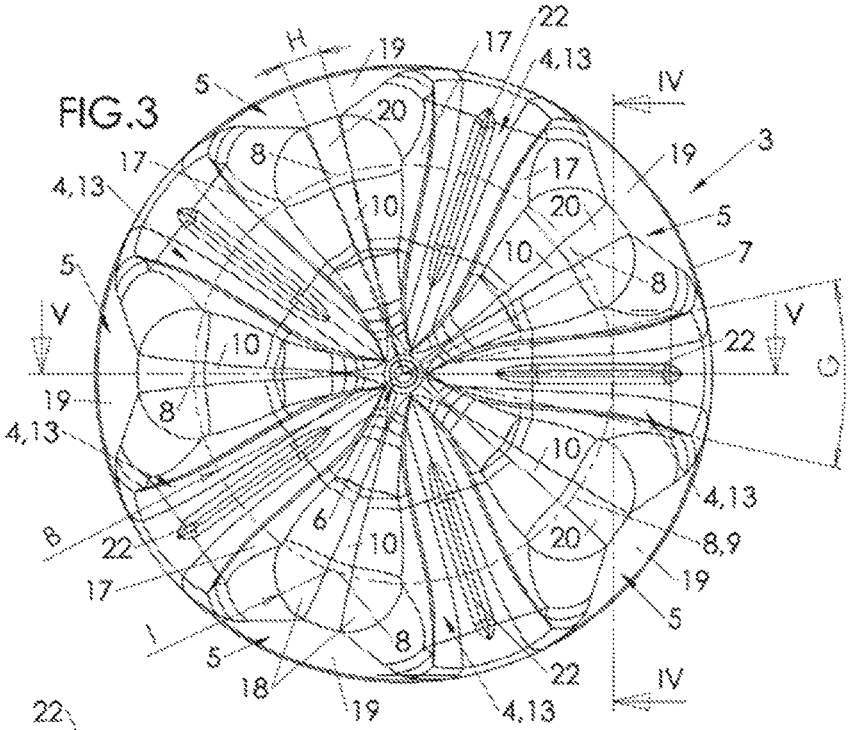
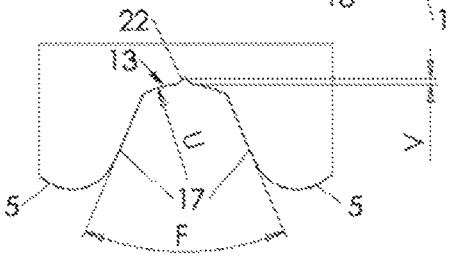
FIG.4
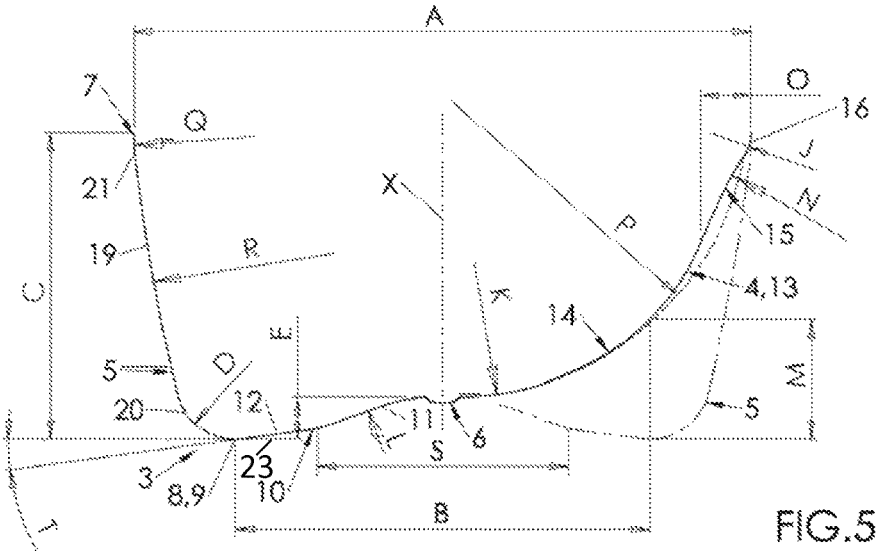
FIG.5

COMBINED PETALOID BASE OF A CONTAINER

CROSS REFERENCE TO RELATED APPLICATIONS

This application is a National Stage of International Application No. PCT/FR2011/052729 filed Nov. 22, 2011, claiming priority based on French Patent Application No. 10 04588 filed Nov. 25, 2010, the contents of all of which are incorporated herein by reference in their entirety.

The invention relates to the manufacture of containers, such as bottles, obtained by blowing or stretch-blowing blanks (preforms or intermediate containers) made of thermoplastic material.

A container generally comprises an open neck through which the contents (ordinarily a liquid) are inserted, a body, which gives the container its volume, and a bottom, which closes the body opposite the neck and forms a base intended to keep the container upright and in place when it is placed on a surface.

Containers intended for carbonated beverages, in which the pressure from the dissolved gas in the liquid produces significant mechanical stresses, are generally provided with bottoms in petaloid form: the bottom comprises projecting petal-shaped feet separated by portions of convex wall, called hollows or valleys, which extend radially from a central zone of the bottom. The feet are intended to ensure that the container maintains its position on a surface; the valleys are intended to absorb the stresses (thermal, mechanical) exerted by the contents.

The performance of a petaloid bottom is measured by its mechanical strength—i.e., its ability to be deformed in a limited or controlled way—not only during filling, but also during the storage of the container. Storage can be prolonged, and can be under severe temperature and hygrometry conditions that are found by way of exception in temperate countries but that are ordinary in countries with a continental, tropical or desert climate.

A frequent deformation that should be avoided is sagging of the central zone of the bottom, because this results in a modification of the configuration of the feet, and in the end, a lack of stability of the container. This is a known problem; see for example French patent application FR 2 897 292 (or its American equivalent US 2009/020682), but the solutions proposed in the past do not offer a compromise that satisfies the mechanical stress performance, which should ideally be high, weight, ideally low, and blowability, ideally easy.

It would therefore seem desirable to propose a container whose petaloid bottom offers such a compromise.

To that end, a container is proposed made of plastic material comprising a body and a petaloid bottom extending the body, the bottom comprising a bottom wall that is generally convex towards the exterior, from which feet protrude that are formed by excrescences, the feet being separated side by side by portions of the bottom wall forming hollow valleys that extend radially from a central zone of the bottom to a periphery of the bottom, each valley widening out from the central zone towards the periphery and having a concave portion located near the periphery.

Such a container has the advantage of having increased resistance to deformation. In particular, good support of the central zone of the bottom is noted under hydrostatic pressure, possibly combined with the pressure from the dissolved gas in the case of a carbonated beverage. These performances are observed not only during filling, but also during extended storage under severe conditions of hygrometry and pressure.

Each valley preferably has an angular opening of between 22° and 30°, for example about 25°.

The concave portion preferably has a radius of curvature of between 0.20 A and 0.70 A (where A is the overall diameter of the bottom), and for example about 0.40 A.

The bottom can comprise a groove of radial extension made in the bottom of each valley.

Moreover, each foot is preferably provided with an outer face that, in radial cross-section, has a convex profile whose radius of curvature is greater than the overall diameter of the bottom, and for example equal to three times the overall diameter of the bottom.

Other objects and advantages of the invention will be seen from the following description, provided with reference to the appended drawings in which:

FIG. 3 is a plan view from below of the bottom of FIG. 2;

FIG. 4 is a partial cross-section of a detail of the bottom of FIG. 3, along cutting plane IV-IV;

FIG. 5 is a cross-sectional view of the bottom of FIG. 3, along cutting plane V-V.

Figure 1:
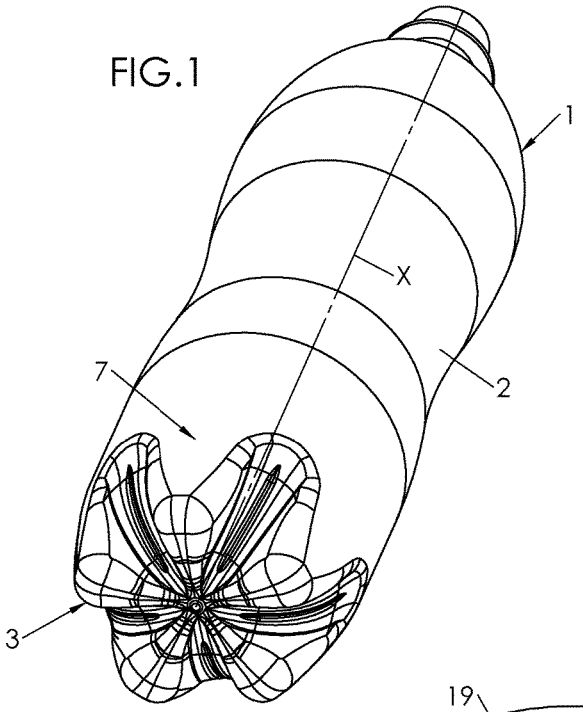
FIG. 1 is a view in perspective from below of a container with a petaloid bottom.

Represented in FIG. 1, in perspective from below, is a container 1—in this instance a bottle—obtained by blowing or stretch-blowing of a preform of thermoplastic material, for example polyethylene terephthalate (PET), previously heated.

The container 1 extends along a principal axis X and comprises a sidewall 2 called body, and a bottom 3 that extends and closes the body 2 at a lower end thereof.

The bottom 3 is petaloid and comprises a bottom wall 4 generally convex in shape towards the exterior of the container 1 (i.e., downwards when the container is set down flat).

The bottom 3 further comprises a series of feet 5 formed by excrescences protruding outwards from the container 1, and which extend from a lozenge-shaped central zone 6 of the bottom 3, where the material remains substantially amorphous, towards a periphery 7 of the bottom 3 where the bottom connects with the body 2. The overall diameter of the bottom 3 is denoted as A, measured at its periphery 7 (FIG. 5).

Figure 2:
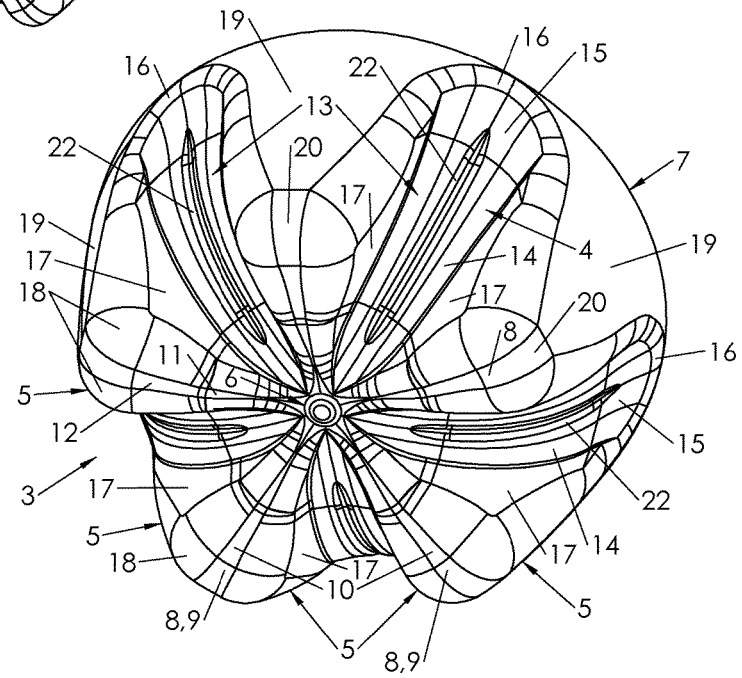
FIG. 2 is a view in larger scale of the bottom of the container of FIG. 1.

As can be clearly seen in FIGS. 2 and 3, the feet 5 become thinner from the interior towards the exterior of the container 1 (i.e., downwards), and become wider from the central zone 6 towards the periphery 7.

The most prominent parts or vertices 8 of the feet 4 are coplanar and jointly form a seat 9 by which the container can rest on a flat surface (for example a table). As can be seen in FIGS. 2 and 3, the seat 9 (indicated in FIG. 3 by a circle drawn in a dotted line), is situated radially set back with respect to the periphery 7. B denotes the diameter of the seat 9, and C denotes the total height of the bottom 3, measured axially from the seating plane 23 to the periphery 7 of the bottom 3, where the bottom connects to the body 2.

Each foot 5 has an end face 10 that extends in a gentle slope [from] the central zone 6 of the bottom 3 towards the vertex 8, so that the foot 5 has a substantially triangular profile in radial cross-section (FIG. 5). More specifically, as illustrated in FIG. 5, the end face 10 has a double slope, and comprises:

an inner section 11, spherical in shape with concavity turned outwards, centered on the axis X of the container 1 and whose radius of curvature is denoted as L and the diameter as S;

an outer flat section 12, radially extending the inner section 11 and with less slope then said inner section, and forming with the seating plane 23 (also called setting plane) an angle denoted as T.

Denoted as E is the axial extension of the end face 10 (also called rise or bottom guard), measured between the seating plane 23 and the central zone 6.

FIG. 3 shows that the end face 10 widens out from the central zone 6 towards the periphery 7. The average angular opening of the end face 10 is denoted as H, measured in the seating plane 23 between two virtual lines joining the axis X at the intersection of the edges of the outer face 10 and of the circle (of diameter B, shown in a dotted line in FIG. 3) joining the vertices 8 of the feet 5.

As can be clearly seen in FIGS. 2 and 3, the feet 5 are separated side by side by the portions 13 of the bottom wall 4 called valleys, which extend radially in star shape from the central zone 6 to the periphery 7.

The valleys 13 are outwardly concave in transverse cross-section (i.e., along a plane perpendicular to the radial direction, see FIG. 4). Denoted as U is the radius of curvature of the valleys 13, measured in transverse cross-section. Said radius U can be variable. More specifically, it is preferably small in proximity to the central zone 6, and relatively larger in proximity to the periphery 7 (see the numerical values in the table below).

Moreover, as illustrated in FIG. 2, and at the right in FIG. 5, the valleys 13 have:

near the central zone 6, an inner section 14 that is outwardly convex in radial cross-section, whose radius of curvature is denoted as K, and near the periphery 7, an outer section 15 that is outwardly concave in radial cross-section, whose radius of curvature is denoted as N and which connects to the periphery 7 by a convex fillet 16 whose radius is denoted as J. The radial extension of this concave portion 15 is denoted as O, measured perpendicular to the axis X (FIG. 5).

It can be seen in FIGS. 2 and 3 that the number of feet 5 is equal to the number of valleys 13. In the example illustrated in the drawings, the bottom 3 comprises five feet 5 and five valleys 13, alternating regularly and distributed in star shape. This number constitutes a good compromise; however, it could be lower (but more than or equal to three), or higher (but preferably less than or equal to seven).

Each foot 5 has two substantially flat flanks 17, each of which laterally borders a valley 13. As can be seen in FIG. 4, the flanks 17 are not vertical (because the bottom 3 would then be difficult or even impossible to blow), but are sloped, opening out from the valley 13 towards the exterior. The average angular opening between the flanks 17 is denoted as F, which designates the average transverse angular opening of the valley 13. As illustrated in FIG. 3, the flanks 17 are connected to the end face 10 by a fillet 18 whose radius is denoted as I.

Furthermore, each foot 5 is radially delimited by an outer face 19 that extends in the extension of the body 3 to the vicinity of the vertex 8, to which the outer face 19 is connected by a fillet 20, whose radius D is measured in a radial plane (FIG. 5). The outer face 19 is not cylindrical, but is substantially conical in revolution around the axis X. Moreover, in radial cross-section, this face is not straight, but is convex with a large radius of curvature R (at the left in FIG. 5). At the periphery of the bottom 3, the face 19 is connected to the body 3 by a fillet with a radius Q, measured in a radial plane.

According to a preferred embodiment illustrated in the drawings, the bottom 3 is further provided with radial grooves 22 that extend recessed towards the interior of the container 1, along the valleys 8 and at the bottom thereof. More specifically, each groove 22 extends along a median line of a valley 13 from the vicinity of the central zone 6 to the vicinity of the periphery 7.

In plan view (FIG. 3), each groove 22 is oblong in shape, having edges that are parallel along most of the length, and both ends of which are tapered. In radial cross-section (FIG. 4), each groove 22 has a flared U-shaped profile. The depth of the grooves 22 is denoted as V.

The function of the grooves 22 is to rigidify the bottom 3. Under the effect of the mechanical stresses exerted on the container 1 (particularly under the effect of the pressure in the container filled with a carbonated liquid), the grooves 22 tend to creep by expanding and flattening, which causes a widening of the valleys 13, resulting in a verticalization of the feet 5, which resists the overall sagging of the bottom 3.

It can be seen in FIG. 3 that each valley 13 widens from the central zone 6 towards the periphery 7. This widening is preferably continuous, i.e., the edges of the valleys 13 form between them an angle that is not zero at any point. In the example shown, the valleys 13 in plan view have a tulip- (or clock-) shaped contour, but this shape is not limiting, and the edges of the valleys 13 could be straight (the valleys 13 then having a V-shaped contour). The average angular opening of the valleys 13 is denoted as G, measured in a plane perpendicular to the axis X between two virtual lines (shown as dotted lines in FIG. 3) joining the axis X and the radial ends of the lateral edges of the valleys 13.

As can be seen in particular in FIG. 2, each valley 13 has no branching (particularly of the side of the periphery 7), and thus forms a single hollow reserve.

The average axial depth of each valley 13 is denoted as M, i.e., the distance, measured parallel to the axis X, between the vertex 8 of the feet 5 and the point of the valley 13 situated at the diameter B, at the vertical of the vertex 8 (see FIG. 5).

Set forth in the following table is a preferred range (i.e., specifically a minimum value and a maximum value) and a preferred example of a guideline value for each of the parameters E to N and Q to V, which can be variable and are for the most part (except for the parameters F, G, H, T and V) calculated as a function of one of the parameters A, B and D, which correspond to fixed dimensions required by the type (particularly the capacity) of the container produced. The height C of the bottom 3 is also a fixed parameter; it is the only independent parameter, i.e., it does not depend on any other parameter and none of the other parameters is calculated on the basis of it.

| Parameter | Min. value | Max. value | Guideline value (±10%) |
|---|---|---|---|
| E | 0.08 B | 0.12 B | 0.10 B |
| F | 35° | 60° | 46° |
| G | 22° | 30° | 25° |
| H | 5° | 15° | 7° |
| I | 0.70 D | D | 0.90 D |
| J | 0.40 D | D | 0.70 D |
| K | 0.40 A | 0.60 A | 0.50 A |
| L | 0.20 B | 0.50 B | 0.32 B |
| M | 0.20 B | 0.35 B | 0.27 B |
| N | 0.20 A | 0.70 A | 0.40 A |

-continued

| Parameter | Min. value | Max. value | Guideline value (±10%) |
|---|---|---|---|
| O | 0.05 B | 0.15 B | 0.10 B |
| Q | 0.20 A | 0.50 A | 0.35 A |
| R | A | 4 A | 3 A |
| S | 0.50 B | 0.80 B | 0.60 B |
| T | 5° | 12° | 8° |
| U | 0.10 B | 0.50 B | |
| V | 0.50 mm | 1.5 mm | 1 mm |

Tests have made it possible to validate these choices by demonstrating the superiority of mechanical performance of the bottom 3 with respect to existing bottoms. In particular, tests that were conducted while varying the parameters allow the hypothesis to be formulated that, while all of the parameters have an influence on the mechanical performance of the bottom 3, it is the combination of the angular opening (angle G) of the valleys 13 and the existence of the concave outer section 15 of the valleys (radius N) that have a preponderant influence.

More specifically, this combination makes it possible to minimize the axial movements of the central zone 6. Indeed, it is observed that, under the internal pressure in the container 1, on the one hand from a swelling of the convex section 14 of the valleys 13, on the other hand by a reversal of the concave section 15, which adopts a convex profile in the extension of the section 14, so that the sections 14 and 15 finally form a single continuous convex profile (indicated by the dashed lines to the right of FIG. 5) having a radius of curvature P that is greater than the radius of curvature K of section 14 at rest. It appears that this combined deformation exerts on the central zone 6 an axial effort directed towards the interior of the container 1, which resists the effort produced by the hydrostatic thrust, to which the additional pressure due to the dissolved gas is added, thus limiting the sagging of the central zone 6.

These effects are not found on a bottom whose valleys have parallel edges, or on a bottom whose valleys are entirely convex in radial cross-section.

We have seen in the table that the value of the radius of curvature N of the concave outer section 15 of the valleys 13 is related to the value of the overall diameter A of the bottom 13 [sic]. According to the tests, it appears to be important that the radius N be less than the diameter A, and even less than about ⅔ A (we used 0.70 A as the upper limit, and 0.40 A as the preferred value), but the radius N should not be too small (the lower limit used is 0.20 A).

Among all of the other parameters, the value of the radius R, combined with the parameters G and N, clearly contribute (but secondarily compared to these latter values) to maintaining the central zone 6 at a substantially constant height after filling. More specifically, it seems important that the value of the radius R be high: we chose it to be greater than the overall diameter A of the container, and equal to three times A in the preferred example. During filling, a slight bulging of the outer face 19 is noted, which contributes to exerting on the whole foot 5 a lever effect articulated around the vertex 8. Said lever effect exerts on the central zone 6 an axial effort directed towards the interior of the container 1, which resists the effort produced by the hydrostatic thrust, to which the additional pressure due to the dissolved gas is added, thus limiting the sagging of the central zone 6.

The invention claimed is:

1. A container made of plastic material comprising a body and a petaloid bottom extending the body, the bottom comprising a bottom wall that is generally convex towards an exterior, from which feet protrude that are formed by excrescences, the feet being separated side by side by portions of the bottom wall forming hollow valleys that extend radially from a central zone of the bottom to a periphery of the bottom, wherein each hollow valley widens out continuously from the central zone towards the periphery, the edges of the valleys form between them an angle that is not zero at any point, each hollow valley has an outer section that is outwardly concave in radial cross-section located near the periphery and the bottom comprises a groove of radial extension made in the bottom of each hollow valley.

2. The container according to claim 1, characterized in that each valley has an angular opening of between 22° and 30°.

3. The container according to claim 2, characterized in that each valley has an angular opening of about 25°.

4. The container according to claim 1, characterized in that the concave outer section has a radius of curvature between 0.20 A and 0.70 A, where A is the overall diameter of the bottom.

5. The container according to claim 4, characterized in that the concave outer section has a radius of curvature equal to 0.40 A.

6. The container according to claim 1, characterized in that each foot is provided with an outer face that, in radial cross-section, has a convex profile whose radius of curvature is greater than the overall diameter of the bottom.

7. The container according to claim 6, characterized in that the radius of curvature of the outer face is approximately equal to three times the overall diameter of the bottom.

8. The container according to claim 1, wherein the petaloid bottom is formed by projecting feet, each having a bulb shape.

9. The container according to claim 1, wherein, relative to a distal end of the bottom of the container, a height of the valleys of the bottom wall at outer radial ends is greater than a height of the central zone; and wherein a height of the valleys of the bottom wall at inner radial ends is at about a same level as the height of the central zone.

10. The container according to claim 1, wherein each foot has a substantially triangular profile in radial cross-section of the petaloid bottom.

11. The container according to claim 1, wherein the groove extends in an inward direction of the container.

12. The container according to claim 1, wherein the container is configured to be supported on a flat surface in a plane by the feet of the petaloid bottom contacting the flat surface within an annular area in the plane, the annular area defined by inner and outer radial dimensions of the feet in the plane, and wherein a total area of the feet within the plane is less than a remaining area of the annular area that does not have the feet.

13. The container according to claim 1, containing a carbonated beverage.

14. A container made of plastic material comprising:

a body, and a petaloid bottom extending the body;

the petaloid bottom from which bulb shaped feet protrude that are formed by excrescences, the feet being separated side by side by portions of the bottom wall forming hollow valleys that extend radially from a central zone of the bottom to a periphery of the bottom, wherein each hollow valley widens continuously from the central zone towards the periphery, the edges of the valleys form between them an angle that is not zero at any point, each hollow valley has an outer section that is outwardly concave in radial cross-section located near the periphery and the bottom comprises a groove of radial extension made in the bottom of each hollow valley; and wherein the bottom petaloid comprises an inner section that is outwardly convex in radial cross-section and at an inflexion transitions to an outer section that is outwardly concave in radial cross-section.

15. The container according to claim 14, wherein the groove extends in an inward direction of the container.

16. The container according to claim 14, wherein the container is configured to be supported on a flat surface in a plane by the feet of the petaloid bottom contacting the flat surface within an annular area in the plane, the annular area defined by inner and outer radial dimensions of the feet in the plane, and wherein a total area of the feet within the plane is less than a remaining area of the annular area that does not have the feet.

* * * * *